US006382808B1

(12) United States Patent
Lin

(10) Patent No.: US 6,382,808 B1
(45) Date of Patent: May 7, 2002

(54) DECORATIVE LIGHTING DEVICE HAVING FLOATING MEMBER

(75) Inventor: Yu Chuan Lin, Chong Ho (TW)

(73) Assignee: Superstar Lighting Co., Ltd., Chong Ho (TW)

( * ) Notice: Subject to any disclaimer, the term of this patent is extended or adjusted under 35 U.S.C. 154(b) by 0 days.

(21) Appl. No.: 09/876,869

(22) Filed: Jun. 8, 2001

(51) Int. Cl.[7] ..... F21V 33/00

(52) U.S. Cl. ..... 362/96; 362/294; 362/806; 40/409

(58) Field of Search ..... 362/35, 96, 294, 362/373, 806, 809; 40/406, 407, 409, 411, 412, 422, 439, 440, 441, 477, 479, 480

(56) References Cited

U.S. PATENT DOCUMENTS

| | | | | | |
|---|---|---|---|---|---|
| 2,100,690 | A | * | 11/1937 | Andler | 40/409 |
| 2,911,745 | A | * | 11/1959 | Simon | 40/409 |
| 2,924,033 | A | * | 2/1960 | Lanctot | 40/411 |
| 3,325,935 | A | * | 6/1967 | Holter | 40/407 |

* cited by examiner

*Primary Examiner*—Y. My Quach-Lee

(57) ABSTRACT

A lighting device includes a floating member, and a fan device for generating an air stream to float and to support and to rotate the floating member. An air guiding device is disposed below the floating member and includes a number of helical flaps for forming a number of helical air passages between the flaps and for generating a helical air stream to support and float the floating member with the air stream. A net is secured to the bottom of the housing and has a number of openings for air circulation purposes. A light may light the patterns on the floating member.

7 Claims, 7 Drawing Sheets

DECORATIVE LIGHTING DEVICE HAVING FLOATING MEMBER

BACKGROUND OF THE INVENTION

1. Field of the Invention

The present invention relates to a lighting device, and more particularly to a lighting device having fan devices for floating the other decorative members.

2. Description of the Prior Art

Typically, the decorative light devices may be formed into various kinds of shapes. For example, the typical excavated pumpkins or skulls are used for decorative purposes in the Halloween festival or in the All Saints' Day. Some people may put the lights or the candles in the pumpkin heads or in the skulls for lighting purposes. However, it is inconvenient to make such decorative lighting devices. The typical light devices have no fan devices for floating the other member.

The present invention has arisen to mitigate and/or obviate the afore-described disadvantages of the conventional lighting devices.

SUMMARY OF THE INVENTION

The primary objective of the present invention is to provide a lighting device including a fan device for floating the other decorative members.

The other objective of the present invention is to provide a lighting device including an air guiding device for generating an air stream to float and to support the decorative member above the fan device.

The further objective of the present invention is to provide a lighting device including a fan device for floating and for rotating the decorative member and for allowing the patterns of the floating member to be changeably shown from various directions.

In accordance with one aspect of the invention, there is provided a lighting device comprising a floating member, and means for generating an air stream to float and to support and to rotate the floating member.

An air guiding device is further provided and disposed below the floating member, the air stream generating means is provided for generating the air stream through the air guiding device in order to hold or float the floating member with the air stream.

The air guiding device includes a plurality of helical flaps for forming a plurality of air passages between the flaps and for generating a helical air stream and for supporting or floating the floating member with the air stream.

The air guiding device includes a receptacle, and a barrel disposed in the receptacle, and the helical flaps are coupled between the receptacle and the barrel for forming the air passages between the flaps.

The air guiding device includes a peripheral wall provided below the receptacle and having a chamber formed therein, and the air stream generating means includes a fan device received in the chamber of the peripheral wall.

A housing is further provided and includes an upper portion, the air guiding device includes a peripheral flange secured on the upper portion of the housing. The air stream generating means includes a fan device received in the housing.

The housing includes a bottom portion having a net secured therein for forming a plurality of openings in the net, and for allowing air to flow into the housing via the openings of the net, and for allowing the fan device to generate the air stream.

A base is further provided and includes an upper portion having a casing provided thereon, the housing includes a cup provided in the bottom portion thereof for engaging and securing into the casing of the base and for securing the housing on the base.

An apparatus is further provided for lighting the floating member, and includes a light device disposed below the floating member for lighting the patterns on the floating member when the light device is energized.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
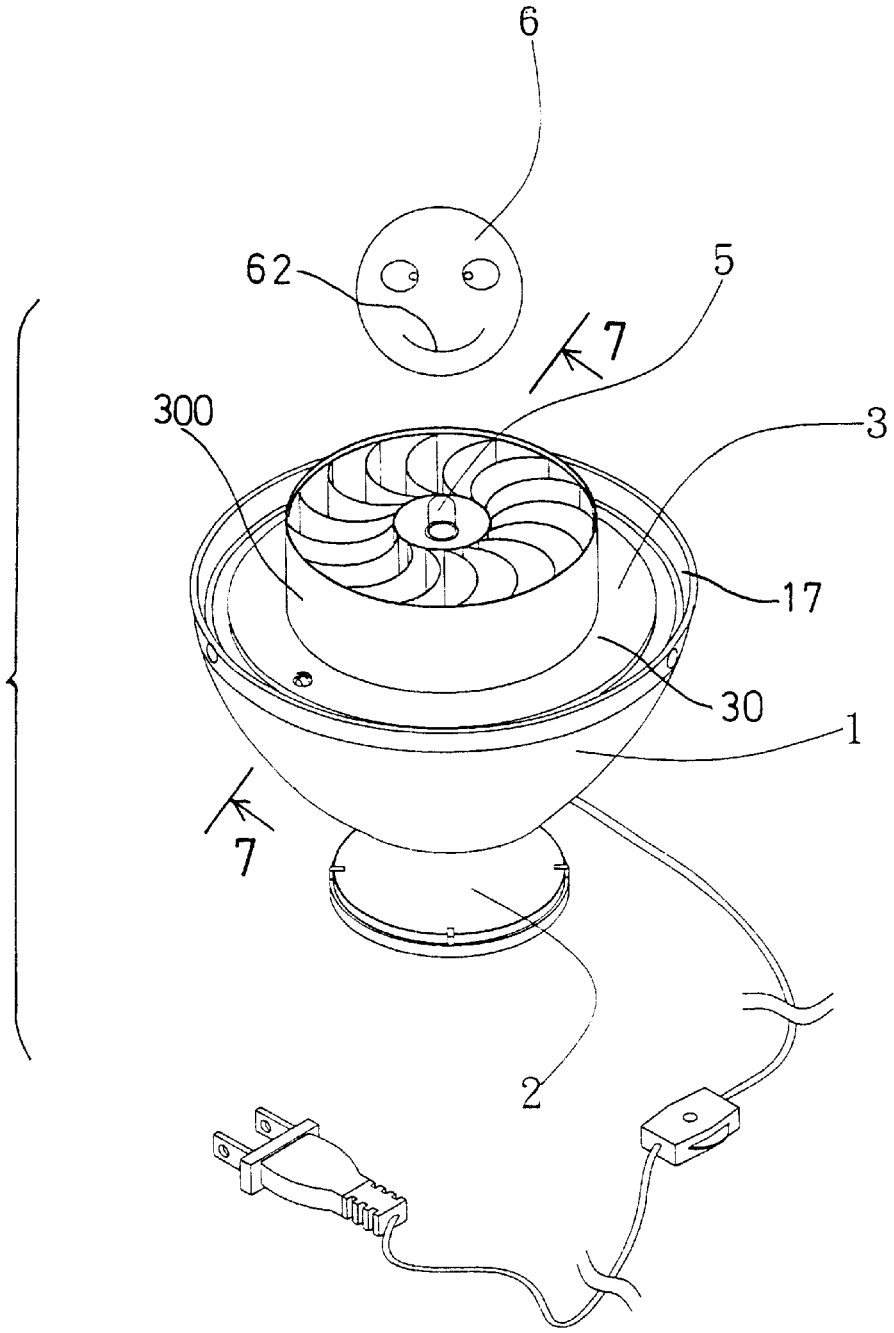
FIG. 1 is a perspective view of a lighting device in accordance with the present invention.

Referring to the drawings, and initially to FIGS. 1–7, a lighting device in accordance with the present invention comprises a cone or bowl-shaped housing 1 including a peripheral flange 17 extended or provided on the outer and the upper portion thereof, and including one or more posts 11 formed or provided in the inner peripheral portion thereof and each having a screw hole 12 formed therein. The housing 1 includes a net 13 disposed and provided in the bottom portion thereof for forming or defining a number of openings 14 therein and for allowing the air to flow into the housing 1, and includes a cup 15 provided and extended downward from the bottom or from the net 13 thereof, and includes a ring 16 disposed in the net 13 or in the bottom portion thereof. A base 2 includes a casing 21 provided on top thereof for receiving the cup 15 and for securing the housing 1 on top of the base 2. One or more fasteners may further be provided for securing the housing 1 on the base 2.

A fan device 4 is received in the housing 1 and engaged on and secured to the inner peripheral portion or the bottom or the net 13 of the-housing 1 with such as the fasteners. A socket 44 is disposed or secured on top of the fan device 4 for receiving a light device 5, such as a light emitting diode, or a light crystal displayer, or a luminous device, etc. The fan device 4 and/or the light device 5 are coupled to a plug 43 via a switch 42, with electric cables 41 which may be threaded through the ring 16 of the housing 1. The plug 43 may be plugged or coupled to the electric power source for energizing the fan device 4 and/or the light device 5. The switch 42 may be used for selectively actuating or controlling the operation of the fan device 4 and/or the light device 5.

An air guiding device 3 includes a peripheral flange 30 for engaging onto the posts 11 of the housing 1 and includes one or more holes 35 formed in the peripheral flange 30 thereof. One or more fasteners 7 may be engaged through the holes 35 of the peripheral flange 30 and may be threaded with the screw holes 12 of the posts 11, for securing the air guiding device 3 in the housing 1 and above the fan device 4. A peripheral wall 36 is extended or provided in the lower portion of the peripheral flange 30 of the air guiding device 3, and includes a chamber 37 formed therein for receiving and securing the fan device 4 therein, with such as a force-fitted engagement or the like, and includes one or more slots 38 (FIG. 5) formed therein for threading the electric cables 41.

Figure 2:
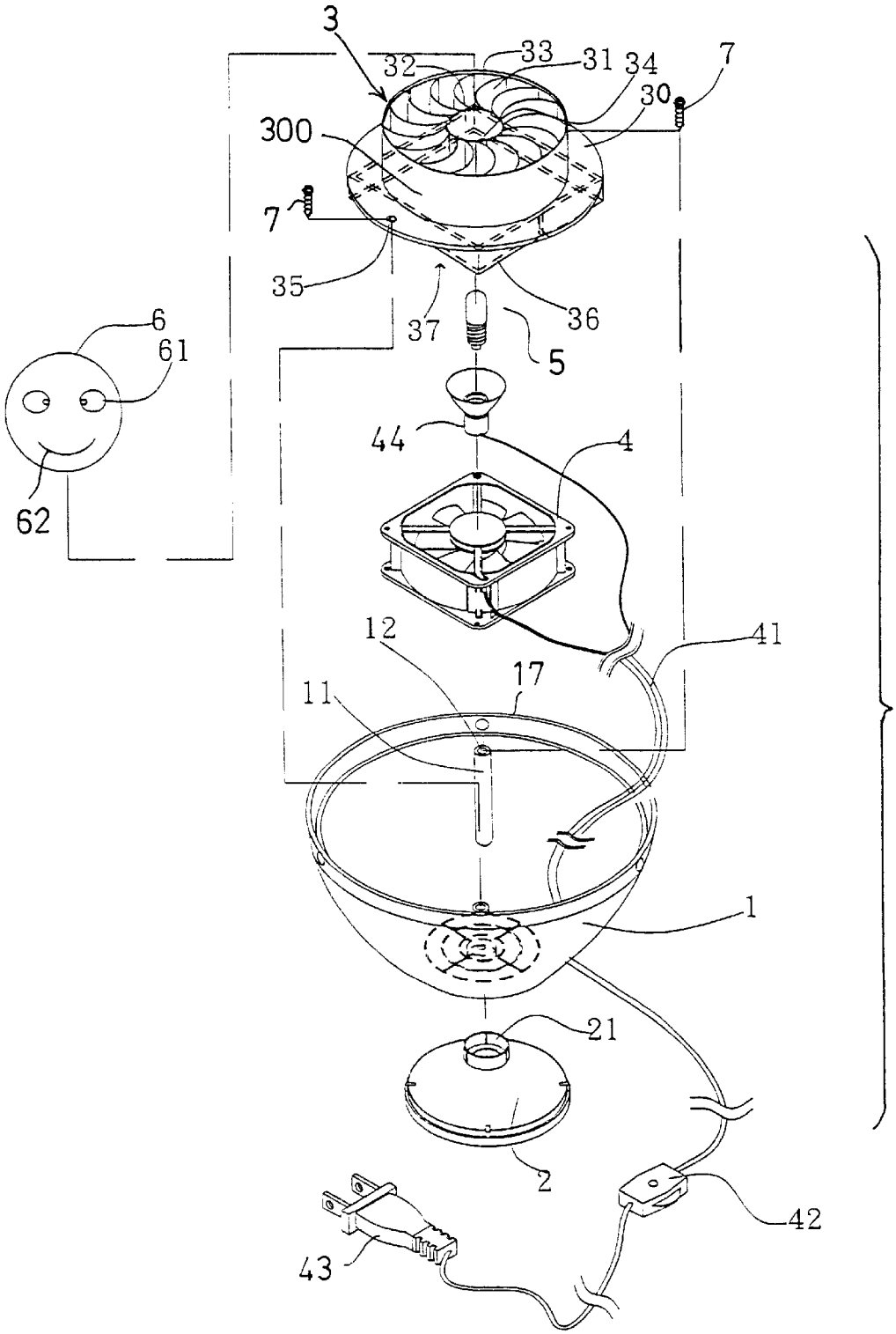
FIG. 2 is an exploded view of the lighting device.
Figure 3:
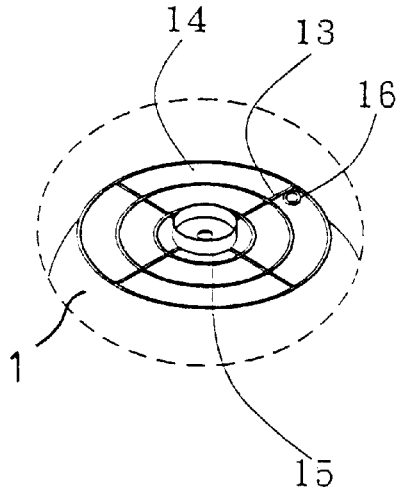
FIG. 3 is a partial bottom perspective view of a housing for the lighting device.
Figure 4:
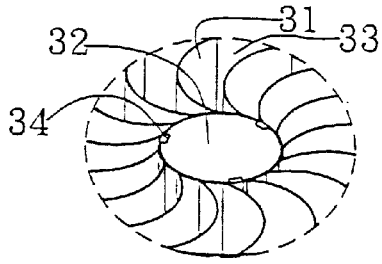
FIG. 4 is a partial upper perspective view of an air guiding device for the lighting device.
Figure 5:
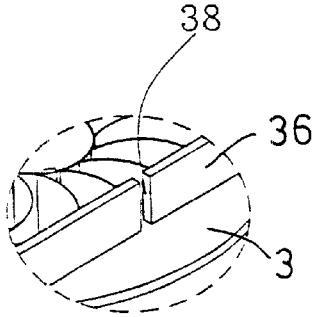
FIG. 5 is a partial bottom perspective view of the air guiding device for the lighting device.
Figure 6:
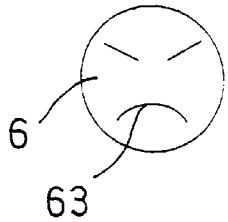
FIG. 6 is a perspective view of a floating member for the lighting device.
Figure 7:
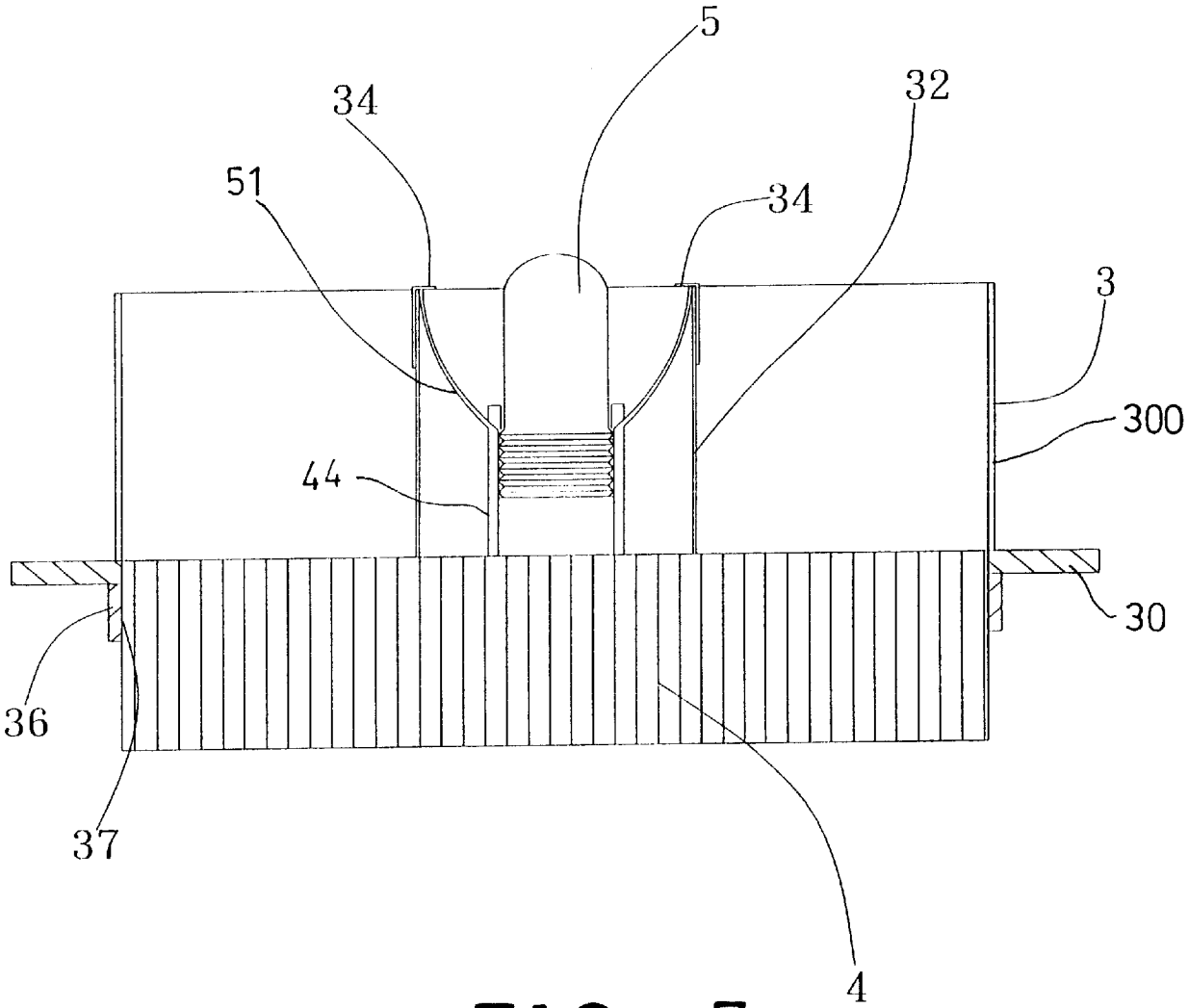
FIG. 7 is a partial cross sectional view taken along lines 7—7 of FIG. 1.

As best shown in FIGS. 2, 4, 7, a cylindrical barrel 32 is provided in the receptacle 300 and concentric with the receptacle 300. One or more hooks or catches 34 are provided on top of the barrel 32 and preferably extended inward of the barrel 32. A reflector 51 (FIG. 7) may be secured between the socket 44 and barrel 32 with the catches 34 for reflecting the light generated by the light device 5. A number of helical flaps 31 are coupled between the receptacle 300 and the barrel 32 for forming or defining a number of air passages 33 that include a substantially helical shape or configuration.

Figure 8:
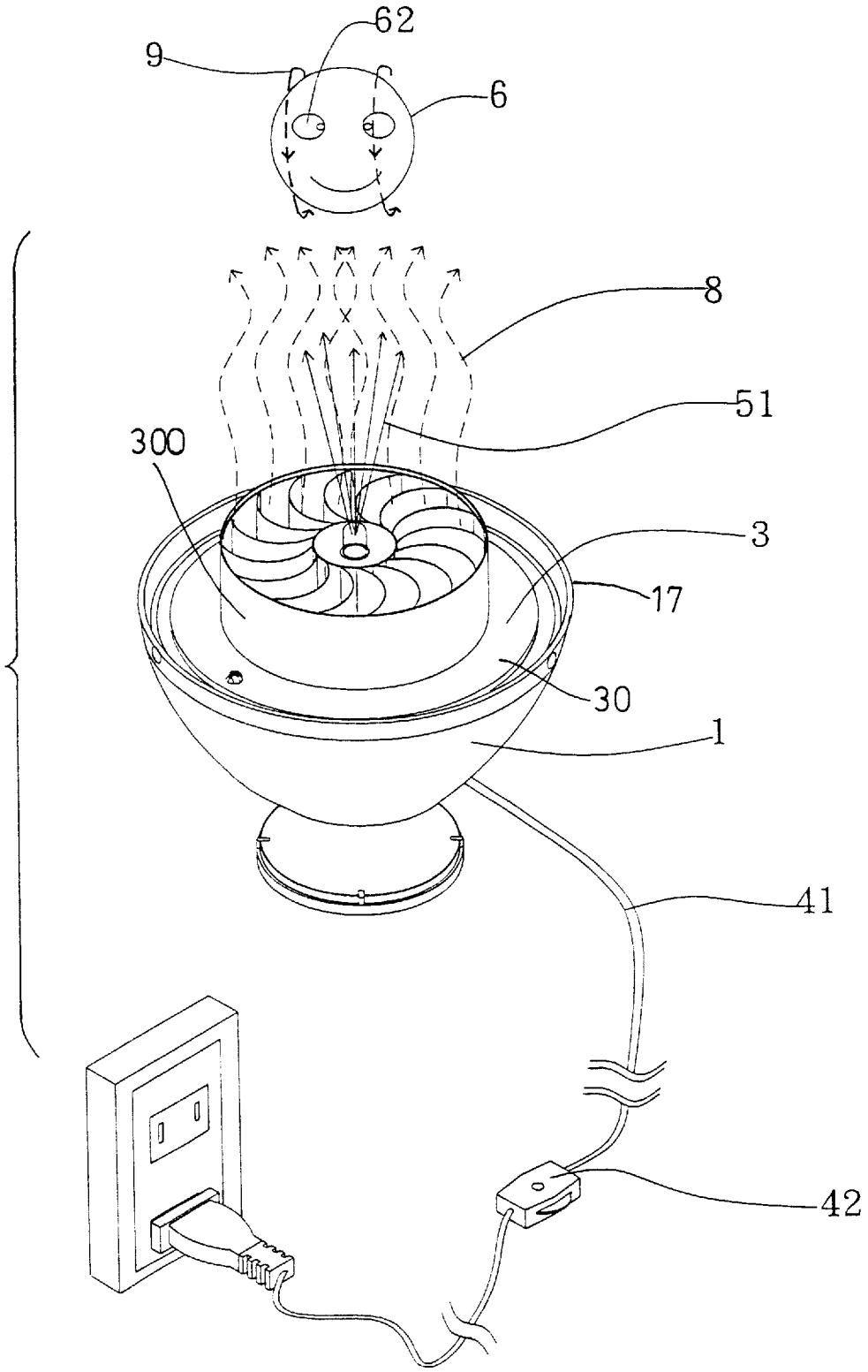
FIGS. 8, 9 and 10 are perspective views illustrating the operation of the lighting device.
Figure 9:
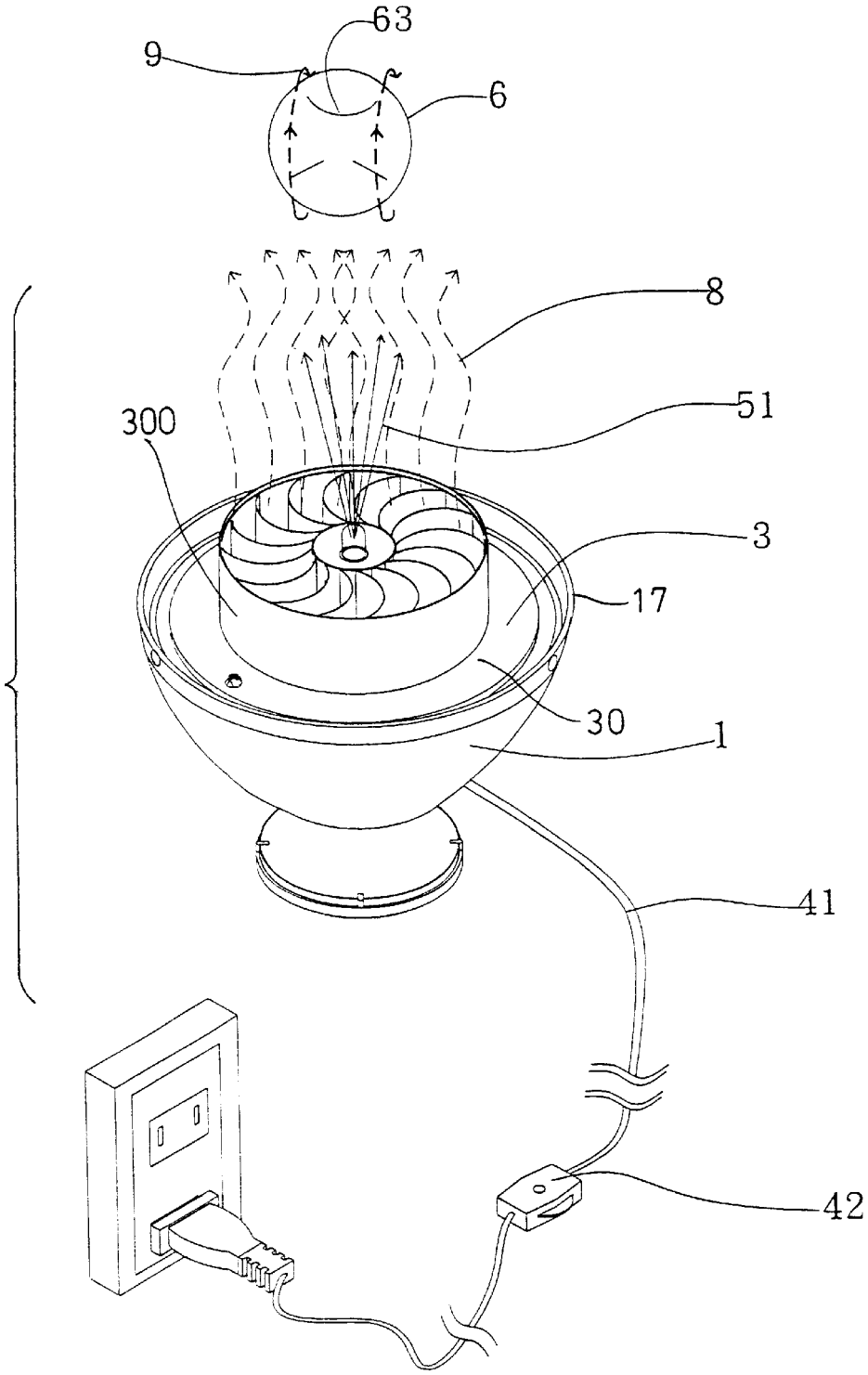
Figure 10:
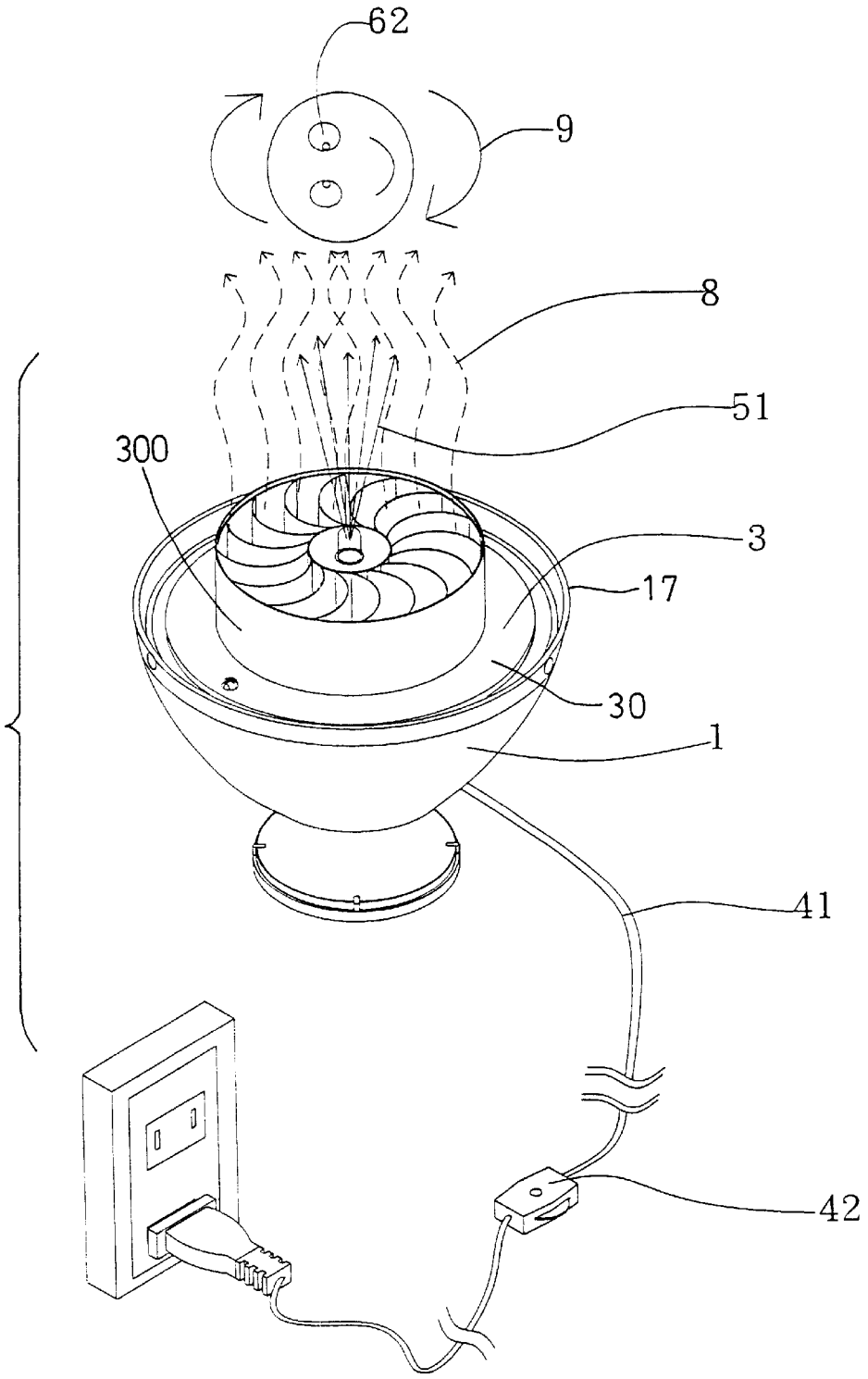

In operation, as shown in FIGS. 8–10, the fan device 4 may be energized to pump or to force the air to flow inward of the housing 1 via the openings 14 of the net 13 or of the bottom portion of the housing 1, and to flow out through the air passages 33 of the air guiding device 3, and thus to flow upward and outward of the air guiding device 3. The helical air passages 33 may guide the air to form the helical air current or helical air stream 8.

A floating or decorative member 6 is disposed above the air guiding device 3, and is made of light materials, such as the foamable materials, the spongy materials, or the like, and includes one or more colors or words or patterns 61, such as the smiling face 62, or the crying face 63 or the like applied on the outer peripheral portion thereof. As shown in FIGS. 8–10, the decorative floating member 6 may be blown upward or floated by the air stream 8, such as the helical air current or air stream 8 generated by the fan device 4, and may be rotated, indicated by the arrows 9, by the air stream 8, such that the patterns 62, 63 of the decorative floating member 6 may be changed as seen from one direction toward the lighting device or toward the housing 1. The weight of the floating member 6 is arranged or selected for allowing the floating member 6 to be floated by the air stream 8, and for preventing the floating member 6 from being moved laterally or sidewise away from the air stream 8. The helical flaps 31 of the air guiding device 3 are also arranged or designed or selected to provide the air stream that may hold or retain the floating decorative member 6 in the middle portion of the air stream 8. The light device 5 may be selectively energized to light the floating member 6, for allowing the patterns 61, 62, 63 of the floating member 6 to be clearly seen by the users.

Accordingly, the lighting device in accordance with the present invention includes a fan device for floating the decorative floating members.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A decorative device comprising:

a floating member, means for generating an air stream to float and to support and to rotate said floating member, and an air guiding device disposed below said floating member, said air guiding device including a plurality of helical flaps for forming a plurality of air passages between said flaps, said air guiding device including a receptacle, and a barrel disposed in said receptacle, and said helical flaps being coupled between said receptacle and said barrel for forming said air passages between said flaps, said air stream generating means being provided for generating said air stream through said air guiding device.

2. A decorative device comprising:

a floating member, means for generating an air stream to float and to support and to rotate said floating member, an air guiding device disposed below said floating member, said air guiding device including a plurality of helical flaps for forming a plurality of air passages between said flaps, said air guiding device including a peripheral wall provided below said helical flaps and having a chamber formed therein, and said air stream generating means including a fan device received in said chamber of said peripheral wall and being provided for generating said air stream through said air guiding device.

3. A decorative device comprising:

a floating member, means for generating an air stream to float and to support and to rotate said floating member, an air guiding device disposed below said floating member, said air stream generating means being provided for generating said air stream through said air guiding device, and a housing including an upper portion, said air guiding device including a peripheral flange secured on said upper portion of said housing.

4. The decorative device according to claim 3, wherein said air stream generating means includes a fan device received in said housing.

5. The decorative device according to claim 3, wherein said housing includes a bottom portion having a net secured therein for forming a plurality of openings in said net, and for allowing air to flow into said housing via said openings of said net.

6. The decorative device according to claim 5 further comprising a base including an upper portion having a casing provided thereon, said housing includes a cup provided in said bottom portion thereof for engaging and securing into said casing of said base and for securing said housing on said base.

7. The decorative device according to claim 3 further comprising a light device disposed below said floating member and directed toward said floating member for lighting said floating member.

* * * * *